US007000290B1

(12) United States Patent
Ace

(10) Patent No.: US 7,000,290 B1
(45) Date of Patent: Feb. 21, 2006

(54) LOCKABLE HINGE

(76) Inventor: James W. Ace, 123 Old Village La., North Topsail Beach, NC (US) 28460

( * ) Notice: Subject to any disclaimer, the term of this patent is extended or adjusted under 35 U.S.C. 154(b) by 0 days.

(21) Appl. No.: 10/912,895

(22) Filed: Aug. 9, 2004

Related U.S. Application Data

(60) Provisional application No. 60/523,561, filed on Nov. 20, 2003.

(51) Int. Cl.
*E05D 11/10* (2006.01)

(52) U.S. Cl. ..... 16/386; 16/229; 16/230; 292/295

(58) Field of Classification Search ..... 16/386, 16/353, 348, 329, 229, 230, 231; 292/288, 292/289, 295 X, DIG. 9, DIG. 17, 303
See application file for complete search history.

(56) References Cited

U.S. PATENT DOCUMENTS

| | | | | | |
|---|---|---|---|---|---|
| 1,166,551 | A * | 1/1916 | Simmons | 16/342 |
| 2,462,268 | A * | 2/1949 | Kahi | 70/1 |
| 3,744,085 | A * | 7/1973 | Griego | 16/325 |
| 4,015,868 | A * | 4/1977 | Buttler | 292/302 |
| 4,490,884 | A * | 1/1985 | Vickers | 16/338 |
| D277,453 | S * | 2/1985 | Wilman | D8/323 |
| 4,564,974 | A * | 1/1986 | McGrail et al. | 16/353 |
| 4,630,333 | A * | 12/1986 | Vickers | 16/338 |
| 4,844,519 | A * | 7/1989 | Dagon | 292/57 |
| 6,591,453 | B1 * | 7/2003 | Jenks | 16/353 |

* cited by examiner

*Primary Examiner*—Brian E. Glessner
*Assistant Examiner*—Mark Williams
(74) *Attorney, Agent, or Firm*—Mills Law Firm PLLC

(57) ABSTRACT

A lockable hinge for preventing opening of a door wherein the fixed and pivoting hinge plates have solid, torque resistant knuckles with aligned passages configured in non circular shapes to permit insertion of a complementary hinge pin thereby preventing opening of the door. The passage may be further configured to permit insertion of a circular hinge pin to selectively allow normal opening and closing of the door.

7 Claims, 10 Drawing Sheets

FIG. 13
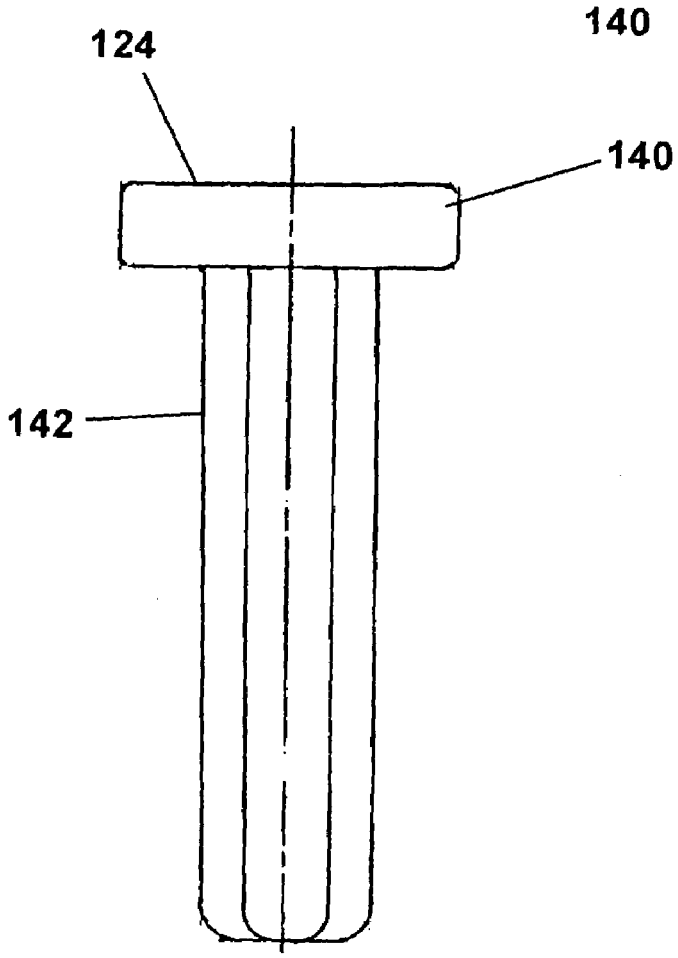
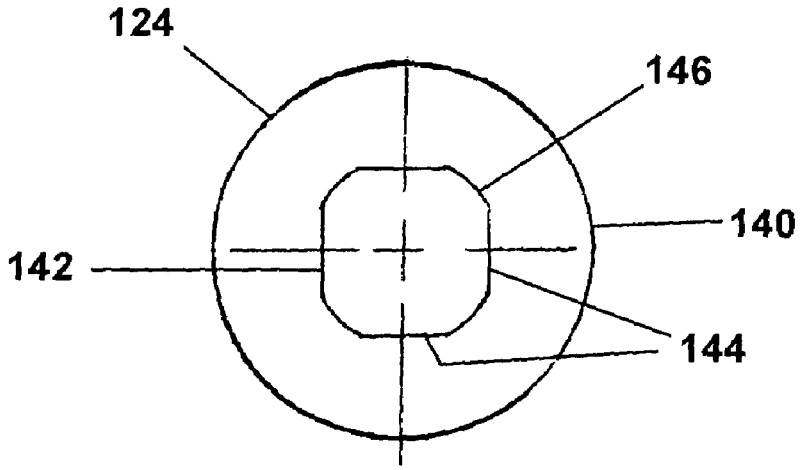
FIG. 14

LOCKABLE HINGE

RELATED APPLICATION

This application claims the benefit of U.S. Provisional Application No. 60/523,561 filed on Nov. 20, 2003 in the name of James W. Ace and entitled "Lockable Hinge".

FIELD OF THE INVENTION

The present invention relates to hinges for closures, and, in particular, a hinge set that may be incorporated on existing doors to provide a selectively locked condition of the door.

BACKGROUND OF THE INVENTION

Conventional doors are supported on the door jam by a plurality of hinge sets allowing the door to pivot from a closed position to an open position. For providing a locked condition, simple locking mechanisms are incorporated in the door handle assembly. Such locks are relatively easy to defeat with simple tools, and accordingly supplemental dead bolt locks are often used for additional protection against unauthorized entrance. In addition to time and expense for installation, the same are also aesthetically unattractive.

Various hinge based devices have been proposed for providing a locking capability directly at the hinges. These approaches has generally been directed to convenience and deterrence rather than security against unwanted intrusion.

U.S. Pat. No. 1,683,814 to Block patent discloses a hinge assembly wherein a circular hinge pin having a radial tab engages a radial slot on the hinge knuckle to prevent opening or limit opening of a door. The assembly is primarily intended for use in low force applications such as limiting door movement to prevent damage to adjacent furniture and doors, acting primarily as an alternative to a door stop. The tab is relatively thin and provides limited shear resistance to the large torques applied in forceful entry.

U.S. Pat. No. 5,642,910 to Betherum discloses a hinge lock that slides over the hinge assembly and captures the hinge plates at slots to prevent movement of the door from a selected position. The design also would be subject to shear and deformation at high force levels.

U.S. Pat. No. 6,591,453 to Jenks discloses a locking hinge system wherein a separate, small diameter pin is inserted into a vertically aligned series of holes outwardly of the hinge pin to lock the hinge plates at open or closed positions. These device is a very light weight construction having small shear interfaces resisting unwanted movement.

BRIEF SUMMARY OF THE INVENTION

The present invention provides a hinge lock that is incorporated into the hinge sets of the door and frame without requiring and structural modifications. More particularly, the invention provides a lockable hinge for preventing opening of a door wherein the fixed and pivoting hinge plates have solid, torque resistant knuckles with aligned passages configured in non-circular shapes to permit insertion of a complementary hinge bolt thereby preventing opening of the door. The passage may be further configured to permit insertion of a circular hinge pin to selectively allow normal opening and closing of the door. The knuckle and pin, additionally, are able to restrain high entry forces without breakage or deformation.

Accordingly, it is an object of the invention to provide a hinge for permitting selective locking between a fixed member and a pivoting member.

Another object of the invention is to provide a hinge for a pivoting door that has non-circular passages in the hinge knuckles for receiving a complementary non-circular hinge pin to restrict pivoting of the door from a select position.

A further object of the invention is to provide hinges for a door that accept either non-circular hinge pins for locking the door against pivoting and a circular hinge pins for permitting normal pivoting.

DESCRIPTION OF THE DRAWINGS

The above and other features of the present invention will become apparent upon reading the following description of the preferred embodiments taken in conjunction with the accompanying drawings in which:

FIG. 13 is a side elevational view of the hinge pin of FIG. 11;

FIG. 14 is a bottom view of the hinge pin of FIG. 13;

DETAILED DESCRIPTION OF THE PREFERRED EMBODIMENTS

Figure 1:
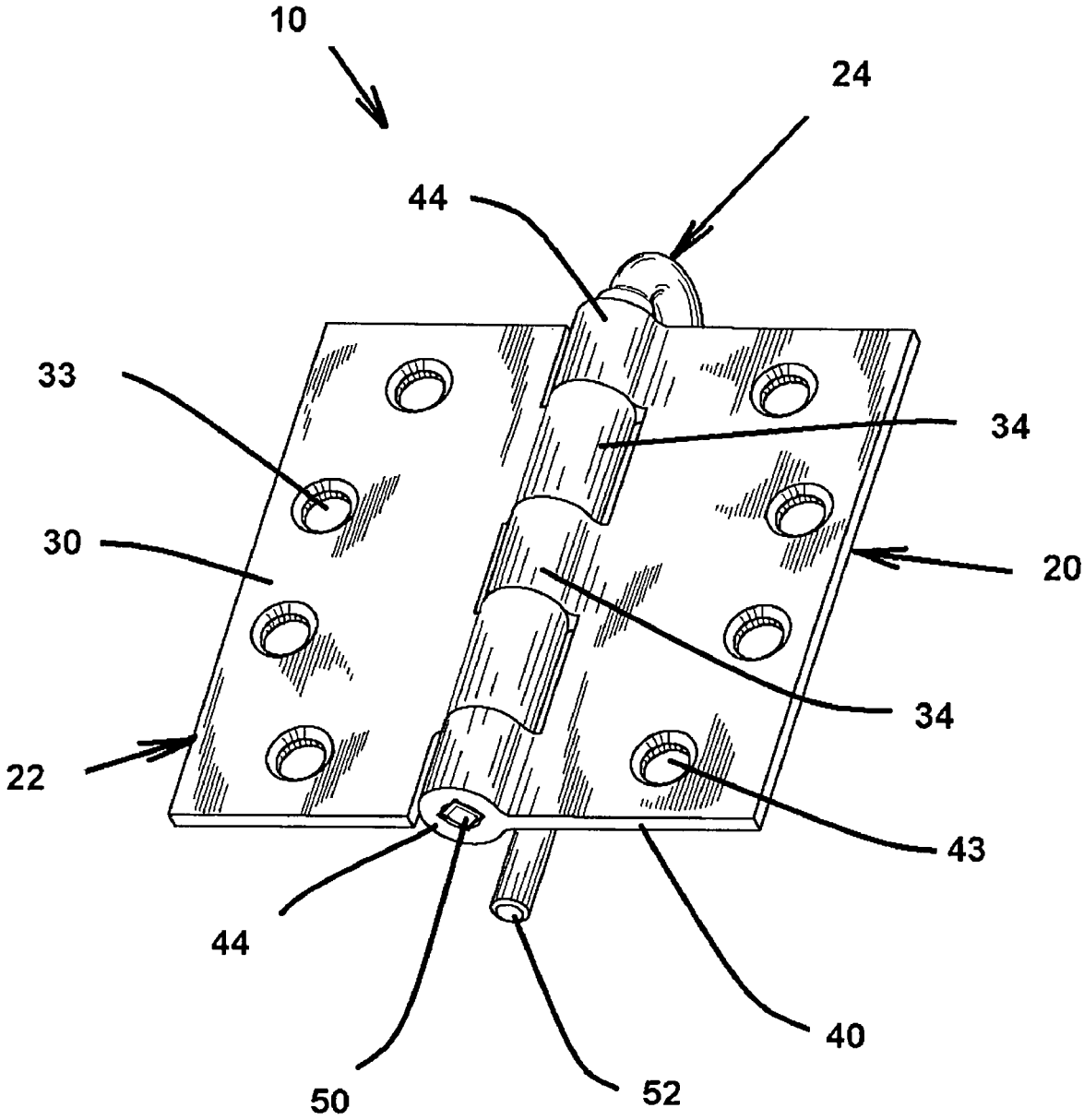
FIG. 1 is a front perspective view of a lockable hinge in accordance with an embodiment of the invention and showing the locked condition.
Figure 2:
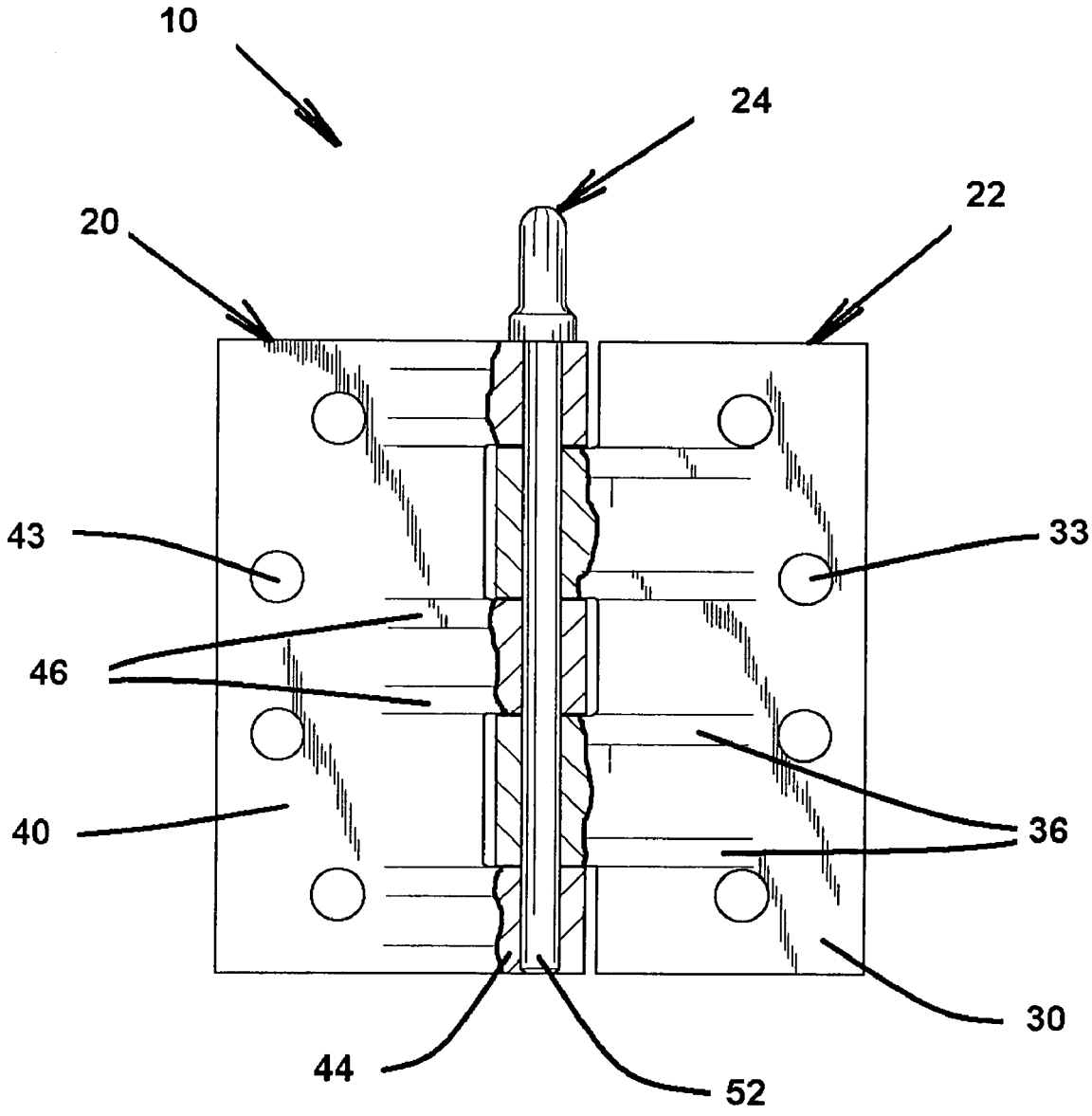
FIG. 2 is a partially sectioned rear view of the lockable hinge and showing the pivoting unlocked condition.

Referring to FIGS. 1 and 2, there is shown a lockable hinge 10 in accordance with an embodiment of the invention for, in combination with conventional or like hinges, controlling pivotal movement of a pivotal panel such as a door, shutter, window or the like with respect to a frame. For door applications, the doors are mounted on the jambs with a plurality of hinges, usually three sets. For light force applications, the lockable hinge 10 may be incorporated on any one of the hinges, preferably the middle hinge in a set of three hinges. For heavy force or security applications, the lockable hinge is preferably incorporated on all three hinges.

The lockable hinge 10 comprises a moveable hinge plate 20 pivotally connected to a fixed hinge plate 22 by a U-shaped combination hinge pin assembly 24. As described in greater detail below, the hinge pin 24 may be positioned in the hinge plates to establish a locked condition as shown in FIG. 1 or a pivoting or unlocked condition as shown in FIG. 2.

Figure 5:
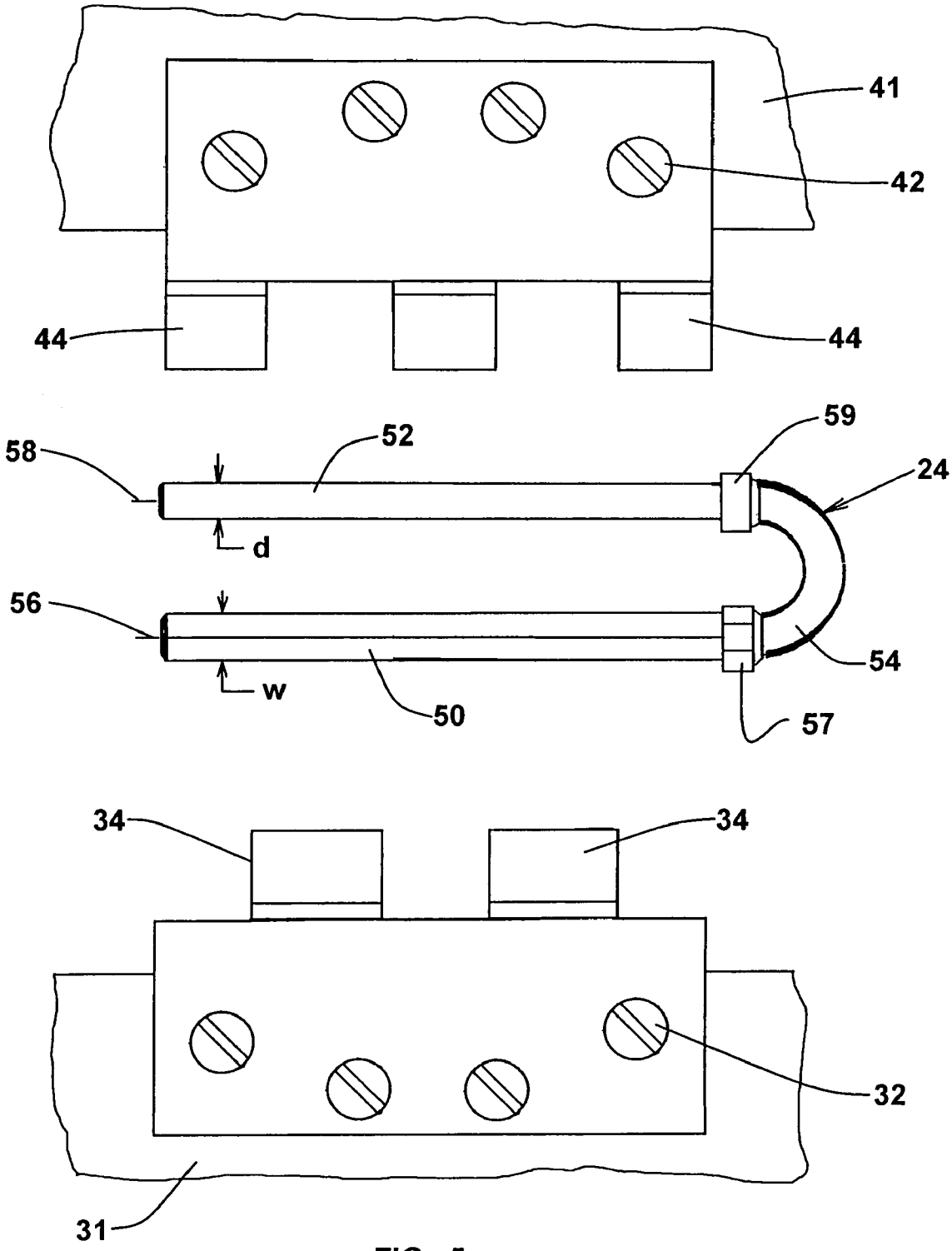
FIG. 5 is a disassembled view of the hinge plates mounted on the door and frame, and the hinge bolt assembly for establishing the locked and pivoting conditions.
Figure 6:
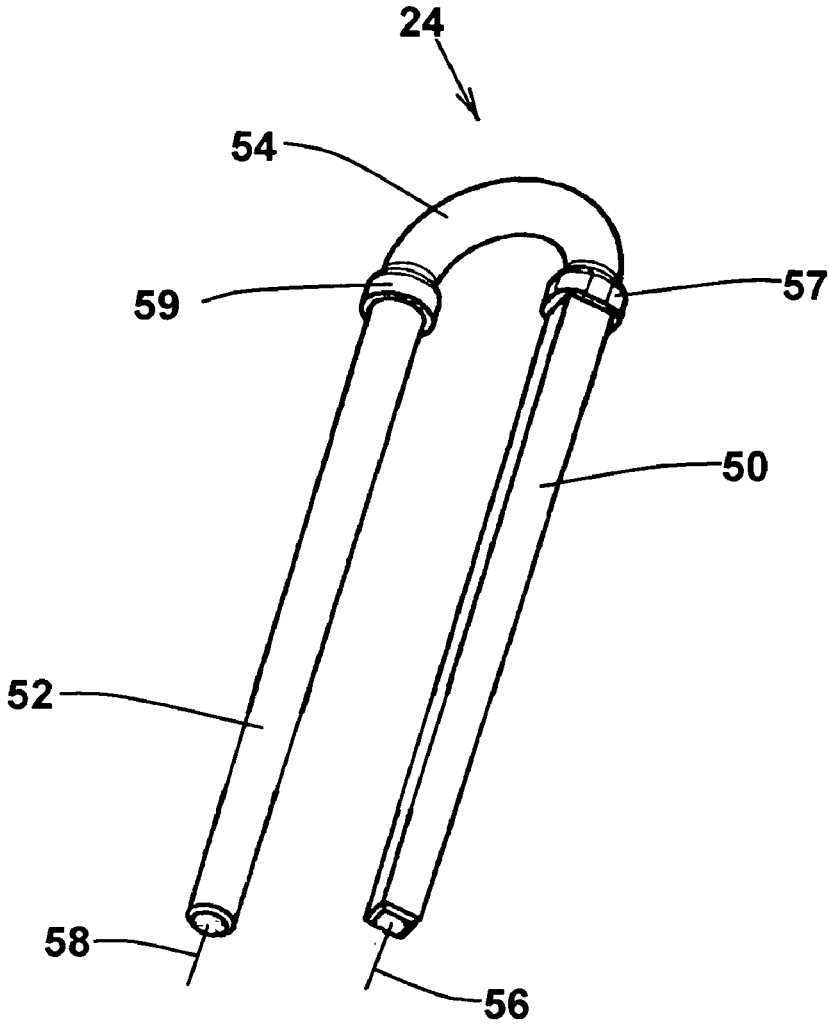
FIG. 6 is a perspective view of the hinge pin assembly.
Figure 7:
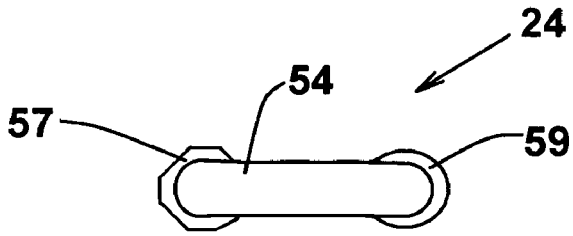
FIG. 7 is a top view of the hinge pin assembly.

Referring additional to FIG. 5, the fixed hinge plate 22 includes a rectangular base 30 which is conventionally mortised into the frame 31 and fixed thereto by fasteners 32 at a plurality of spaced, fastener holes 33 countersunk on the front surface. The fixed hinge plate 22 includes three vertically spaced, solid cylindrical hinge sleeves or knuckles 34. The front surface of the hinge plate 22 is planar. The rear surface of the hinge plate 22 is planar and includes a pair of generally triangular ribs 36 extending rearwardly and tapering inwardly from each knuckle 34. The ribs 36 provide structural reinforcement against deformation of the base under loading. The fixed hinge plate 22 is preferably a one-piece die cast member.

The moveable hinge plate 20 includes a rectangular base 40 conventionally mortised into the side of the door 41 and fixed thereto by fasteners 42 at a plurality of vertically spaced fastener holes 43 countersunk on the front surface. The moveable hinge plate 20 includes two vertically spaced solid cylindrical hinge sleeves or knuckles 44 laterally slidably interleaved between the knuckles 34 of the fixed hinge plate 22 in a conventional manner. The front surface of the hinge plate 20 is planar. The rear surface of the hinge plate 20 in planar and includes a pair of generally triangular ribs 46 extending rearwardly and tapering inwardly from the knuckles 44. The ribs 46 provide structural reinforcement against deformation of the base under loading. The fixed hinge plate 22 is preferably a one-piece die cast member.

Figure 3:
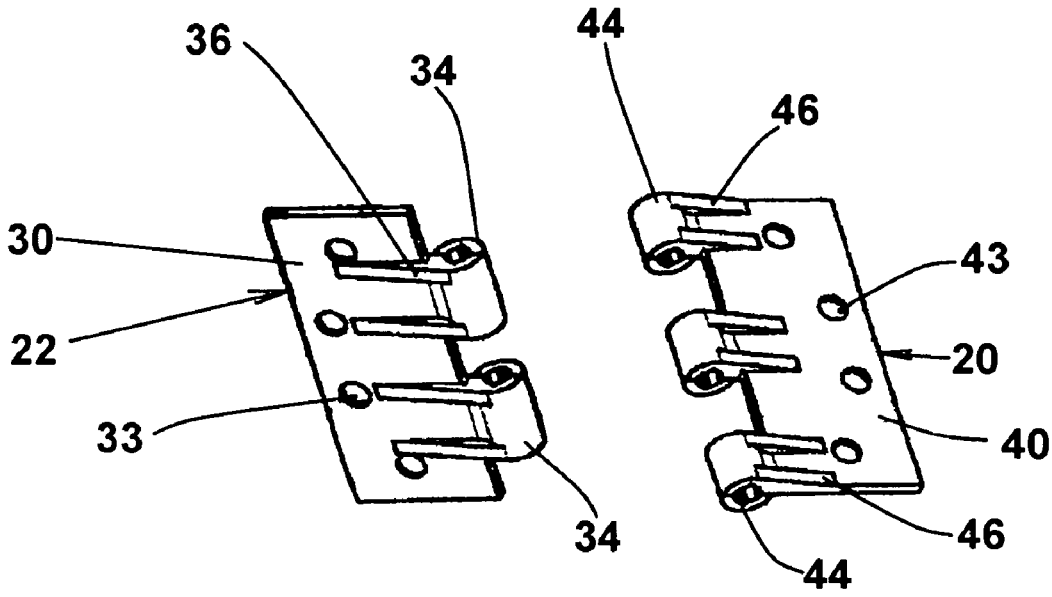
FIG. 3 is a rear perspective view of the hinge plates for the lockable hinge.
Figure 4:
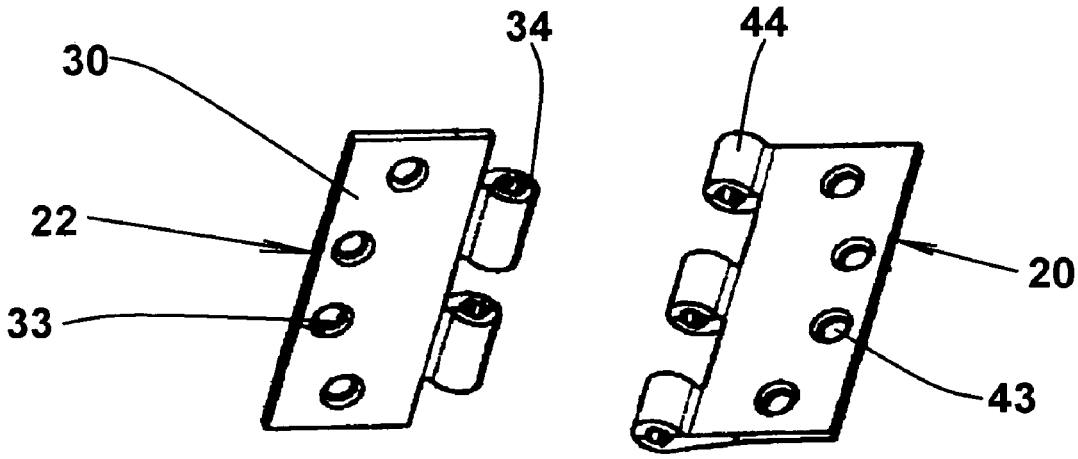
FIG. 4 is a front perspective view of the hinge plates.

Referring to FIGS. 3 and 4, the hinge pin assembly 24 includes an elongated locking pin 50 and an elongated pivot pin 52 located parallel thereto and interconnected by a semicircular connecting hook 54. The pins 50 and 52 have laterally spaced axes, 56 and 58 respectively. The locking pin 50 has a square cross section having a width "w'. The pivot pin 52 has a circular cross section having a diameter "d" which is larger than the width "w". The axial length of the locking pin 50 and the pivot pin 52 is substantially the same as length of the fixed hinge plate 22 and the spacing between the end faces of the outer knuckles. The locking pin 50 is connected with one end of the hook 54 at an enlarged stop collar 57 having a polygonal cross section providing visual shape association with the locking pin 50. For example, a typical installation would have a locking pin with a width of 0.250 in and a pivot pin of 0.280 in. diameter.

The pivot pin 52 is connected with the other end of the hook 54 an enlarged stop collar 59 having a circular cross section providing a visual shape association with the pivot pin 52. Accordingly, in assembly, a user may identify the condition of the lock hinge 10 by observing the shape of the stop collar adjacent the upper knuckle.

Figure 8:
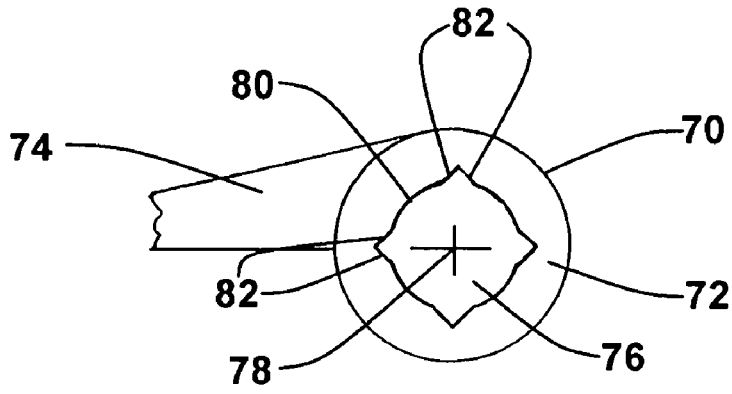
FIG. 8 is an enlarged fragmentary view of a representative hinge knuckle showing details of the pin passage.
Figure 9:
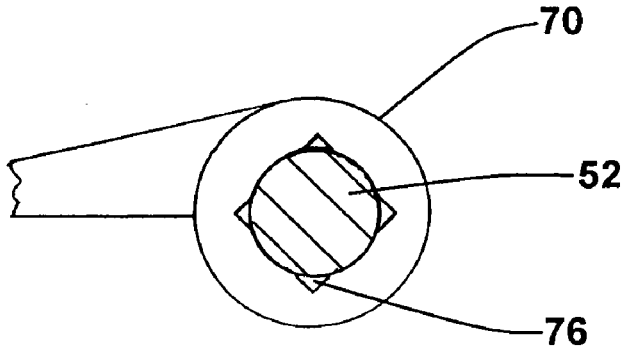
FIG. 9 is an enlarged fragmentary view of the hinge knuckle of FIG. 8 with the lock pin disposed in the locked condition.
Figure 10:
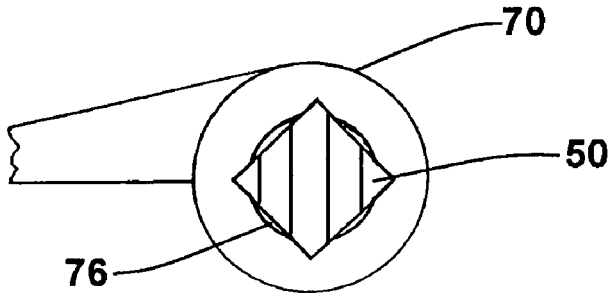
FIG. 10 is an enlarged fragmentary view of the hinge knuckle with the pivot pin disposed in the pivoting condition.

The knuckles are coaxially aligned in assembly to allow the locking pin 50 and pivot pin 52 to be selectively slidably disposed through coaxial passages therein. Referring to FIGS. 8 through 10, a representative knuckle 70 includes a cylindrical body 72 merging with a reinforcing rib 74 and including a pin passage 76 symmetrically formed about a vertical axis 78.

The pin passage 76 is a compound cross sectional surface a square section having a sliding fit with the locking pin 50 (FIG. 10) and superimposed a circular section of greater diameter than the width of the square section and having a sliding fit with the pivot pin 52 (FIG. 9). Each sector of the passage surface includes a cylindrical center section 80 and a pair of planar ends 82. In assembly, the pivot pin 52 is journaled at the center sections 80 for free pivoting of the door. The locking pin 50 reacts against the ends 82 to establish the locked condition of the door. Although other polygonal shapes may be used for the locking pin and passage, the square design provides at least two distinct positions in the locked condition: a fully closed position for the door and an open position, 90° therefrom.

For installation, the door frame and door are suitably mortised to accept the respective hinge plates. The reinforcing ribs 36, 46 are accommodated by supplemental mortising or by local deformation in assembly. Thereafter, the door is mounted on the frame using the pivot pins for assembly. When it is desired to establish a locked condition, one or more or all of the pivot pins are sequentially removed and the locking pin(s) of the pin assembly inserted. For light force resistance, only the center hinge assembly is reversed. For higher force resistance, two or all of the hinge assemblies are reversed.

Figure 11:
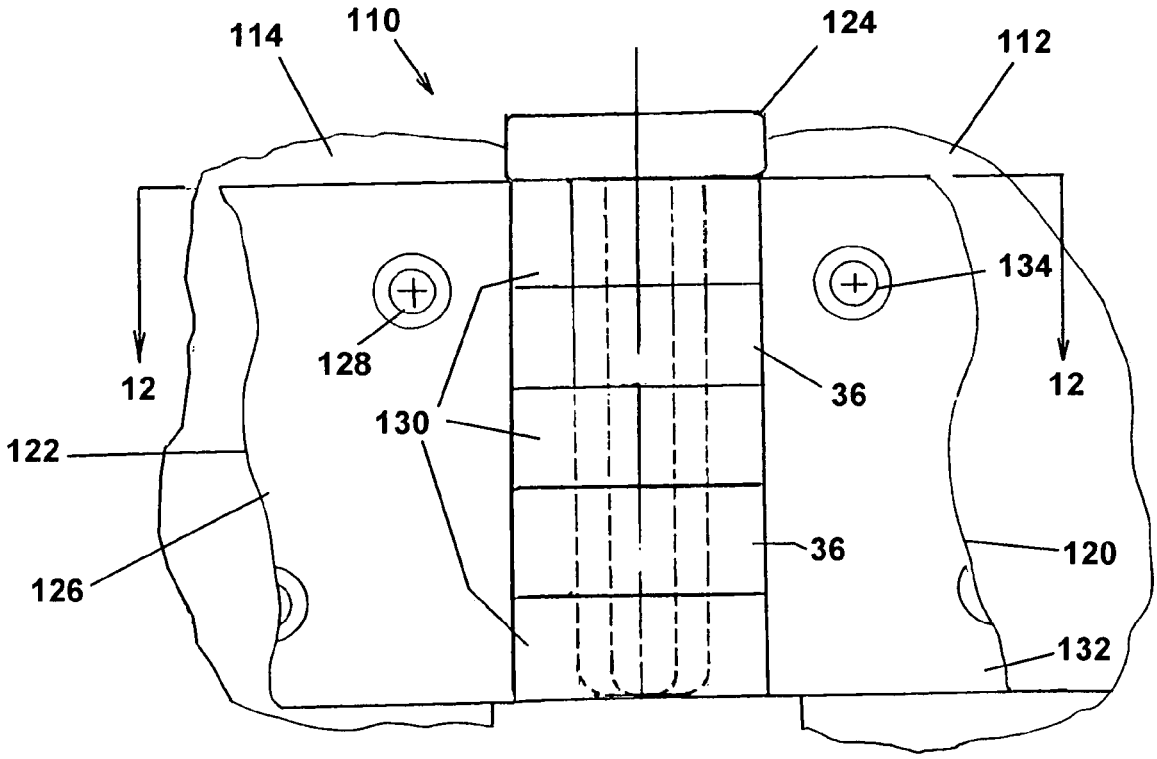
FIG. 11 a front view of a lockable hinge in accordance with another embodiment of the invention.
Figure 12:
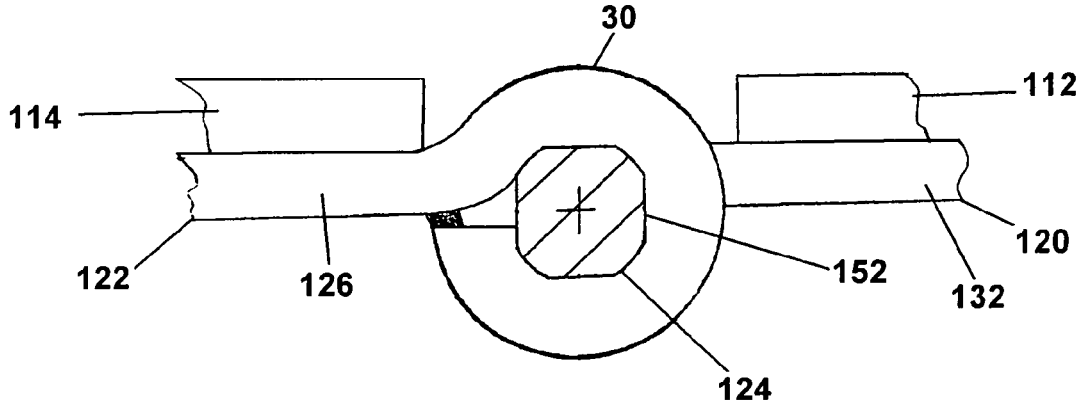
FIG. 12 is a top view taken along line 12—12 in FIG. 11.

Referring to FIGS. 11 and 12, there is shown a further embodiment of a lockable hinge 110 for, in combination with conventional or like hinges, controlling pivotal movement of a door 112 with respect to a door jam 114. Typically, doors are mounted on the jambs with a plurality of hinges, usually three sets. The lockable hinge 110 may be incorporated on any one of the hinges, preferably the middle hinge in a set of three hinges.

The lockable hinge 110 comprises a moveable hinge plate 120 pivotally connected to a fixed hinge plate 122 by a locking hinge pin 124. The fixed hinge plate 122 includes a generally rectangular base 126 conventionally mortised into the jam 114 and fixed thereto by fasteners 128. The fixed hinge plate 122 includes three vertically spaced hinge knuckles 130. The moveable hinge plate 120 includes a generally rectangular base 132 conventionally mortised into the side of the door 12 and fixed thereto by fasteners 134. The moveable hinge plate 120 includes two vertically spaced hinge knuckles 136 slidably interleaved between the knuckles 130 of the fixed hinge plate.

Referring to FIGS. 13 and 14, the hinge pin 124 includes a circular head 140 and a downwardly extending locking pin 142 having a non-circular, square cross section. The locking pin 142 includes four mutually perpendicular side walls 144 circumferentially connected with slightly rounded transition walls 146. The locking pin 142 has a length substantially the same as the height of the hinge bases.

Figure 15:
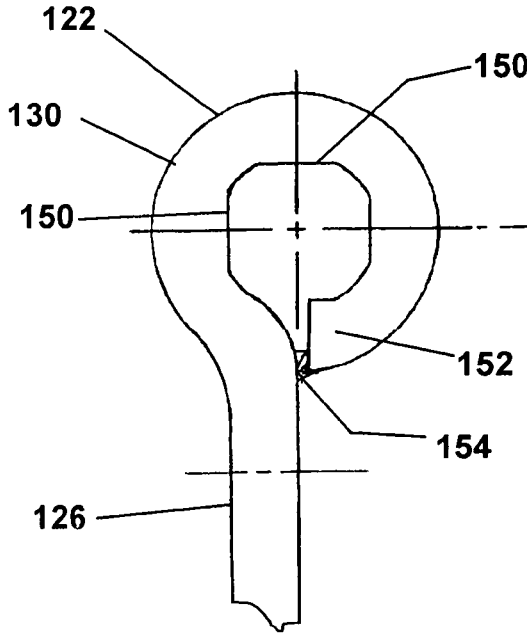
FIG. 15 is a top view of the moveable hinge plate of the lockable hinge of FIG. 11.

Referring to FIG. 15, the fixed hinge plate 122 is stamped from a metal plate with lateral tabs corresponding to the knuckles 130. The knuckles 130 are formed around a mandrel having a cross section complementary with the locking pin 142 to form a vertical passage defined by three mutually perpendicular inner walls 150 and a partial width distal tab 152. The tab 152 is structurally connected to the base 126 at weld 154.

Figure 16:
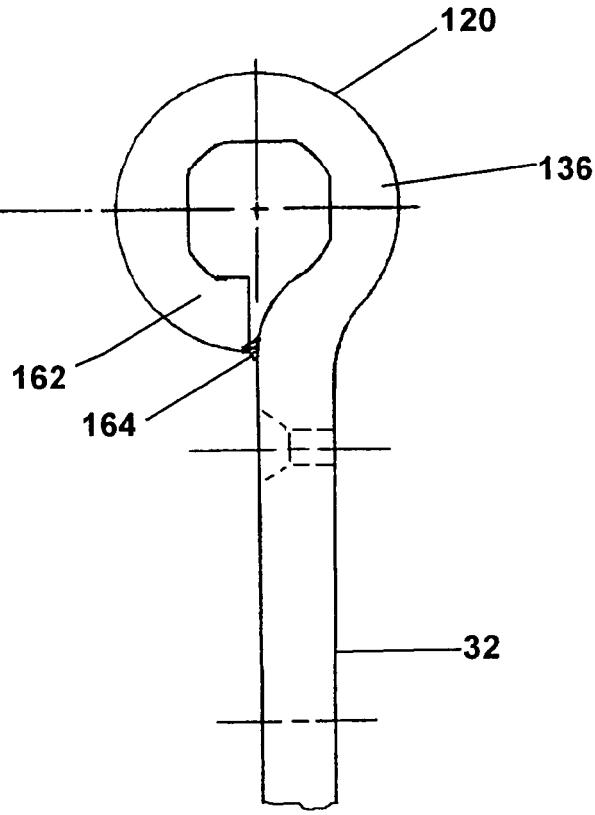
FIG. 16 is a top view of the fixed hinge plate of the lockable hinge of FIG. 11.

Referring to FIG. 16, the moveable hinge plate 120 is stamped from a metal plate with lateral tabs corresponding to the knuckles 136. The knuckles 136 are also formed around a mandrel having a cross section complementary with the locking pin 142 and defined by three mutually perpendicular inner walls 160 and a partial width distal wall 162 structurally connected to the base 132 at weld 164. The walls 160 and 162 define a vertical passage through the knuckles 136 for slidably receiving the locking pin 124. Accordingly, the pin 124 may be slidably inserted into or removed from the passage for providing locked and unlocked conditions for the door.

In assembly, the foregoing construction provides a locking system for hinged doors wherein removal of the locking pin 124 from the lockable hinge allows the door 112 to swing freely between open and closed positions about the other two hinges. When it is desired to provide a locked condition for the door, the locking pin 124 is inserted in the locking hinge. The non-circular locking pin and the complementary journaling at the knuckles prevents relative rotation of the hinge plates 126, 132 establishing a locked condition. Further, the welding of the knuckle tabs to the plates provides substantial hoop strength thereby providing a construction that resists highly leveraged loadings. For unlocking, the pin is removed and stored.

Figure 17:
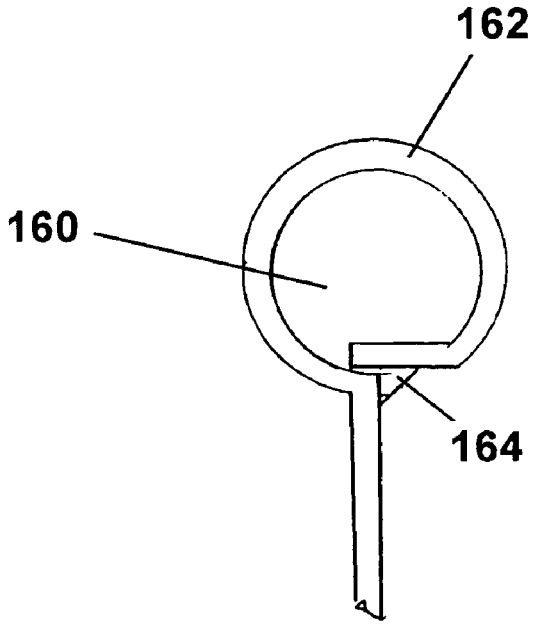
FIG. 17 is a top view of a another embodiment of the invention.
Figure 18:
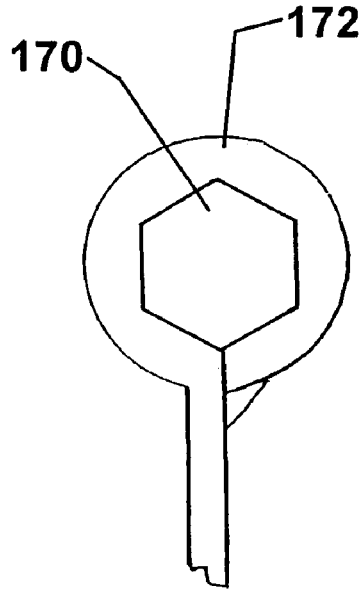
FIG. 18 is a top view of a further embodiment of the invention.

It will be apparent that other non-circular configuration of the pin and hinge knuckles may be alternatively used. For instance as shown in FIG. 17, a circular pin 160 with an axial notch may be incorporated with the circular knuckle 162 having an indented tang 164 welded to the hinge plate 166 will provided a locked condition in a comparable manner. Other non-circular pin cross sections and complementary knuckles such as the hexagonal shapes shown in FIG. 18 may be used.

Having thus described a presently preferred embodiment of the present invention, it will now be appreciated that the objects of the invention have been fully achieved, and it will be understood by those skilled in the art that many changes in construction and widely differing embodiments and applications of the invention will suggest themselves without departing from the sprit and scope of the present invention. The disclosures and description herein are intended to be illustrative and are not in any sense limiting of the invention, which is defined solely in accordance with the following claims.

What is claimed:

1. A lockable hinge for pivotally interconnecting a door with a door frame, said hinge comprising: a first hinge plate having a base for mounting on the door and a plurality of integral first annular members extending in a spaced axial series, first apertures having a first non-circular cross section extending through said first annular members along a first common axis; a second hinge plate having a base for mounting on the door frame and a plurality of integral second annular members extending in a spaced axial series, second apertures having a second non-circular cross section similar to that of said first non-circular cross section extending through said second annular members along a second common axis, said annular members interfitting and coaxially aligning said first common axis with said second common axis wherein said non-circular cross sections in said annular members are defined by an axially extending compound surface peripherally circumscribed by a square section and a coaxially aligned circular section of greater diameter than the width of said square; an elongated hinge pin assembly, said hinge pin assembly including a first pin member and a second pin member, said first having a square cross section slidably received in said first and second apertures and preventing relative pivotal movement between said hinge plates and said second pin member has a circular cross section slidably inserted with respect to said circular sections and journaled for permitting pivotal movement between the door and the frame.

2. The lockable hinge as recited in claim 1 including connector means for connecting said first pin member and said second pin member in spaced relation.

3. The lockable hinge as recited in claim 2 wherein said connector means is a U-shaped member integral with and connected at one end of each pin member.

4. The lockable hinge as recited in claim 3 including an enlarged first collar having a polygonal cross section at said one end of said first pin member for visual association therewith, and an enlarged second collar having a circular cross section at said one end of said second pin member for visual association therewith.

5. The lockable hinge as recited in claim 1 wherein said annular members are cylindrical sleeves.

6. The lockable hinge as recited in claim including triangular reinforcing ribs interconnecting said sleeves with said bases.

7. The lockable hinge as recited in claim 6 wherein said hinge plates are formed as single piece die castings.

* * * * *